US005671564A

United States Patent [19]

Lyle

[11] Patent Number: 5,671,564

[45] Date of Patent: Sep. 30, 1997

[54] COMMUNICATION PORTAL

[76] Inventor: Stanley D. Lyle, P.O. Box 3162, Landers, Calif. 92285

[21] Appl. No.: 770,987

[22] Filed: Dec. 20, 1996

[51] Int. Cl.[6] ..... E06B 7/28

[52] U.S. Cl. ..... 49/171

[58] Field of Search ..... 49/163, 169, 171; 109/21.5

[56] References Cited

U.S. PATENT DOCUMENTS

| | | | |
|---|---|---|---|
| 775,798 | 11/1904 | Chase | 49/171 |
| 1,340,673 | 5/1920 | Roe | 49/171 X |

FOREIGN PATENT DOCUMENTS

| | | | |
|---|---|---|---|
| 1088131 | 3/1955 | France | 49/171 |
| 299213 | 10/1928 | United Kingdom | 49/171 |

*Primary Examiner*—Kenneth Dorner
*Assistant Examiner*—Jerry Redman

[57] ABSTRACT

A communication portal including a circular interior component comprising an outer plate and an inner plate. The outer plate has a plurality of apertures therethrough. The outer plate has an arcuate slot therethrough. The inner plate has a plurality of apertures therethrough. The inner plate has a knob extending outwardly therefrom. The inner plate is urged against the outer plate with the knob extending through the arcuate slot whereby shifting of the knob to a first position will align the apertures of the outer plate and the inner plate. Shifting of the knob to a second position will disalign the apertures. Also included is a circular exterior component comprising a singular plate. The singular plate has a plurality of slots therethrough. The plurality of slots are aligned with the plurality of apertures of the outer plate of the circular interior component. The singular plate is coupled with the circular interior component within an opening in an existing door.

5 Claims, 3 Drawing Sheets

COMMUNICATION PORTAL

BACKGROUND OF THE INVENTION

1. Field of the Invention

The present invention relates to a communication portal and more particularly pertains to providing a safer means for identifying a person knocking on a door with a communication portal.

2. Description of the Prior Art

The use of door safety systems is known in the prior art. More specifically, door safety systems heretofore devised and utilized for the purpose of identifying a person without opening a door are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,273,956 to Wolfe discloses an audioscope project.

U.S. Pat. No. 4,584,436 to Boenning et al. discloses a door-mounted combination intercom and viewer.

U.S. Pat. No. Des. 341,146 to Stankosky discloses the ornamental design for an orifice plate.

U.S. Pat. No. 4,130,728 to Grauel discloses a combined mounting for through-the-wall viewer and intercom.

U.S. Pat. No. 4,809,320 to Hawkins et al. discloses a door security system.

U.S. Pat. No. 4,791,762 to Hwang discloses a noise and burglar preventive door and window apparatus.

While these devices fulfill their respective, particular objective and requirements, the aforementioned patents do not describe a communication portal for providing a safer means for identifying a person knocking on a door.

In this respect, the communication portal according to the present invention substantially departs from the conventional concepts and designs of the prior art, and in doing so provides an apparatus primarily developed for the purpose of providing a safer means for identifying a person knocking on a door.

Therefore, it can be appreciated that there exists a continuing need for new and improved communication portal which can be used for providing a safer means for identifying a person knocking on a door. In this regard, the present invention substantially fulfills this need.

SUMMARY OF THE INVENTION

In the view of the foregoing disadvantages inherent in the known types of door safety systems now present in the prior art, the present invention provides an improved communication portal. As such, the general purpose of the present invention, which will be described subsequently in greater detail, is to provide a new and improved communication portal and method which has all the advantages of the prior art and none of the disadvantages.

To attain this, the present invention essentially comprises a door having an opening therethrough. The opening is about five feet above a recipient surface. The opening has a diameter of a predetermined distance. The device includes a circular interior component comprising an outer plate and an inner plate. The circular component is positioned with respect to the opening at an interior of the door. The outer plate has a diameter of a predetermined distance greater than the diameter of the opening in the door. The outer plate has an inwardly extending peripheral wall abutting the door. The outer plate has a pair of internally threaded collars extending inwardly therefrom. The outer plate has a plurality of apertures therethrough arranged in two concentric circles. The outer plate has an arcuate slot therethrough disposed within an outer circle thereof. The inner plate has a diameter of a predetermined distance less than the diameter of the opening in the door. The inner plate has a plurality of apertures therethrough arranged in two concentric circles. The inner plate has a knob extending outwardly therefrom disposed within an outer circle thereof. The circular interior component includes a central shaft extending through a central portion of the inner plate and secured to a central portion of the outer plate. The central shaft has a spring disposed thereon for urging the inner plate against the outer plate with the knob extending through the arcuate slot whereby shifting of the knob to a first position will align the apertures of the outer plate and the inner plate. Shifting of the knob to a second position will disalign the apertures. The device includes a circular exterior component comprising a singular plate. The circular exterior component is positioned with respect to the opening at an exterior of the door. The singular plate has a diameter of a predetermined distance equal to the diameter of the outer plate of the circular interior component. The singular plate has a plurality of slots therethrough. The plurality of slots are aligned with the plurality of apertures of the outer plate of the circular interior component. The singular plate has a pair of externally threaded rods extending inwardly thereof for coupling with the internally threaded collars of the outer plate.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved communication portal which has all the advantages of the prior art door safety systems and none of the disadvantages.

It is another object of the present invention to provide a new and improved communication portal which may be easily and efficiently manufactured and marketed.

It is a further object of the present invention to provide a new and improved communication portal which is of durable and reliable construction.

An even further object of the present invention is to provide a new and improved communication portal which is susceptible of a low cost of manufacture with regard to both materials and labor, and which accordingly is then susceptible of low prices of sale to the consuming public, thereby making such a communication portal economically available to the buying public.

Even still another object of the present invention is to provide a new and improved communication portal for providing a safer means for identifying a person knocking on a door.

Lastly, it is an object of the present invention to provide a new and improved communication portal including a circular interior component comprising an outer plate and an inner plate. The outer plate has a plurality of apertures therethrough. The outer plate has an arcuate slot therethrough. The inner plate has a plurality of apertures therethrough. The inner plate a knob extending outwardly therefrom. The inner plate is urged against the outer plate with the knob extending through the arcuate slot whereby shifting of the knob to a first position will align the apertures of the outer plate and the inner plate. Shifting of the knob to a second position will disalign the apertures. Also included is a circular exterior component comprising a singular plate. The singular plate has a plurality of slots therethrough. The plurality of slots are aligned with the plurality of apertures of the outer plate of the circular interior component. The singular plate is coupled with the circular interior component within an opening in an existing door.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
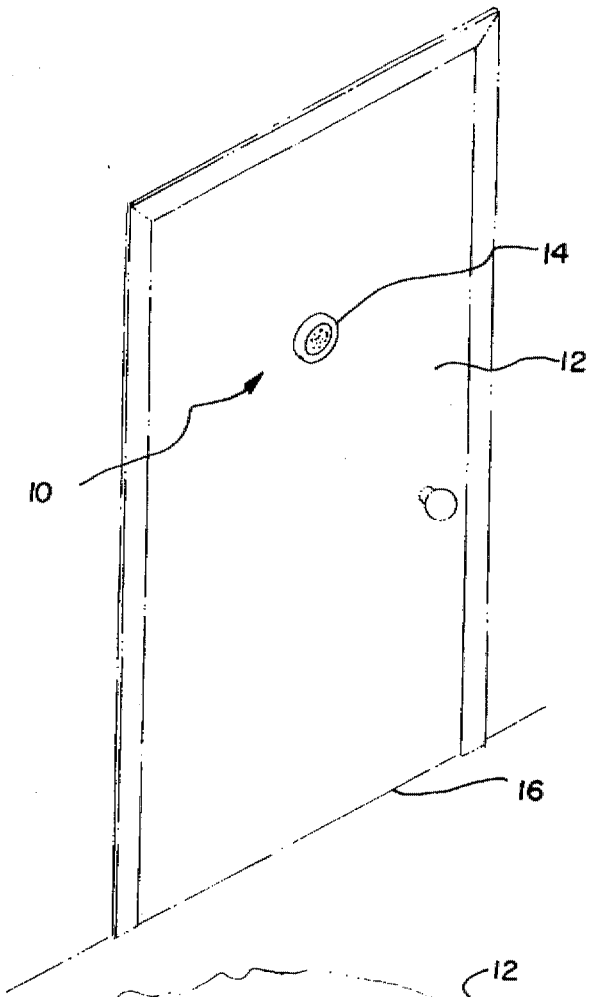
FIG. 1 is a perspective view of the preferred embodiment of the communication portal constructed in accordance with the principles of the present invention.
Figure 2:
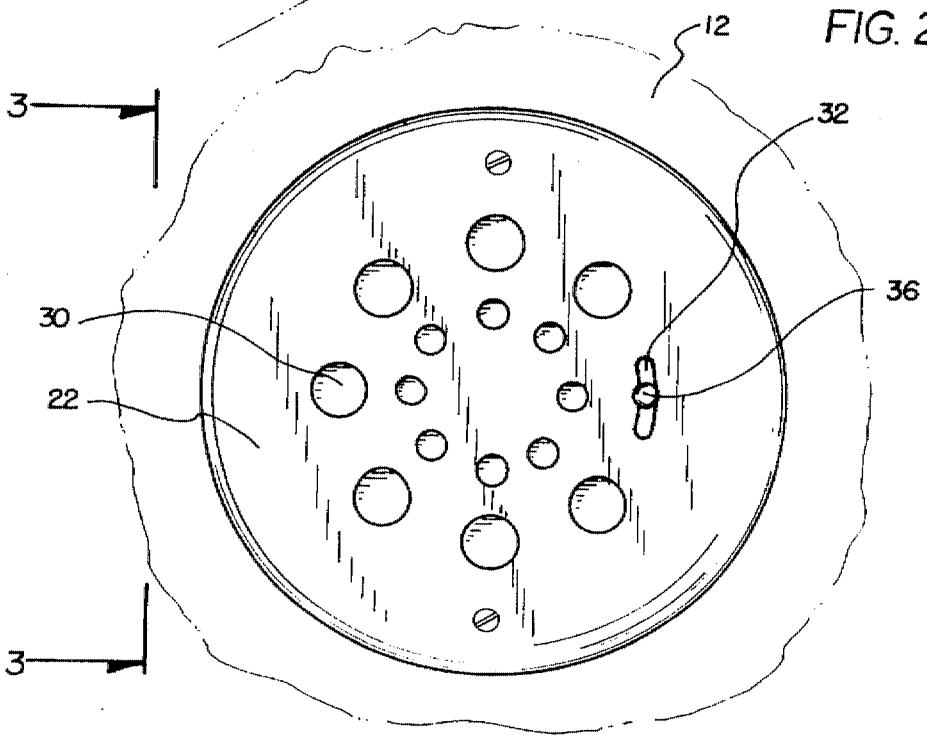
FIG. 2 is a front elevation view of the present invention shown from inside the door.
Figure 3:
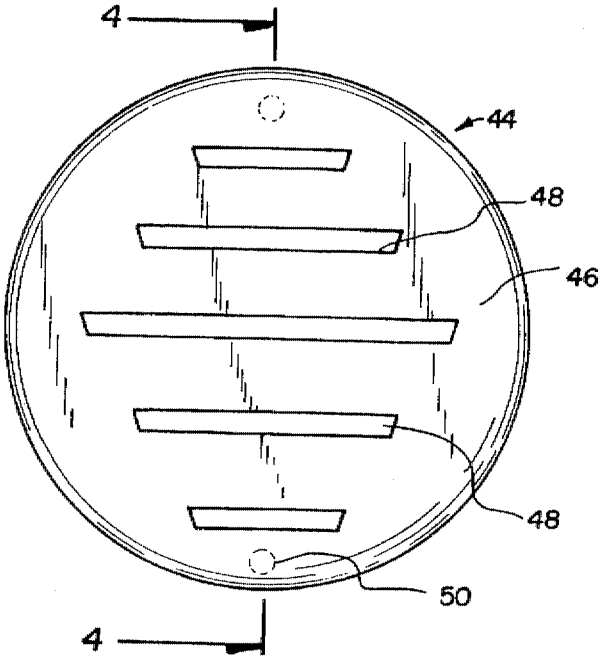
FIG. 3 is a front elevation view of the present invention shown from outside of the door.
Figure 4:
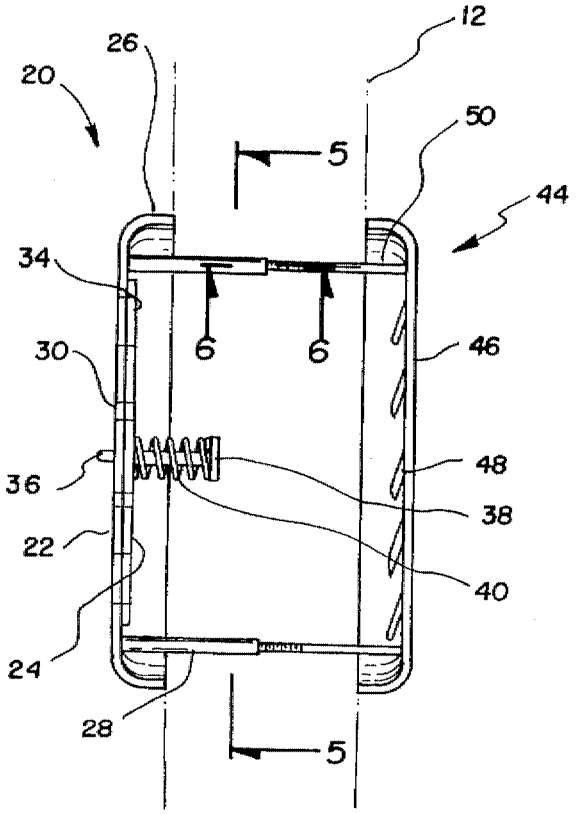
FIG. 4 is a cross-sectional view as taken along line 4—4 of FIG. 3.
Figure 5:
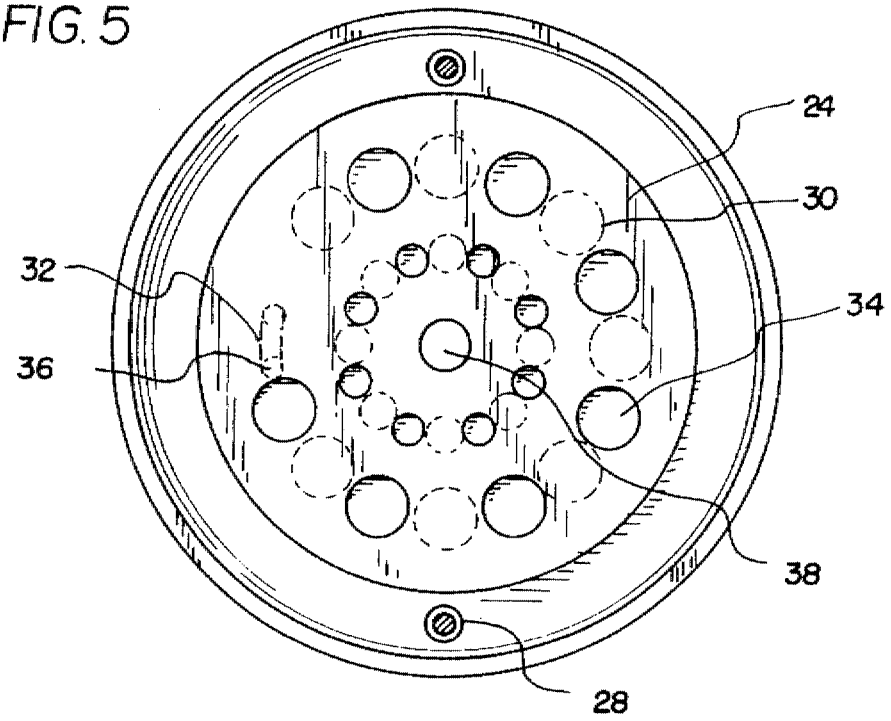
FIG. 5 is a cross-sectional view as taken along line 5—5 of FIG. 4.
Figure 6:
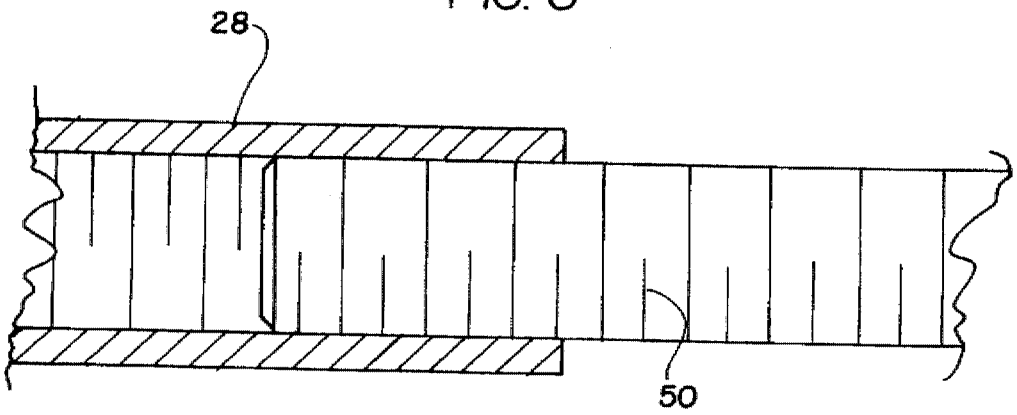
FIG. 6 is a cross-sectional view as taken along line 6—6 of FIG. 4.

With reference now to the drawings, and in particular, to FIGS. 1 through 6 thereof, the preferred embodiment of the new and improved communication portal embodying the principles and concepts of the present invention and generally designated by the reference number 10 will be described.

Specifically, it will be noted in the various Figures that the device relates to a communication portal for providing a safer means for identifying a person knocking on a door. In its broadest context, the device consists of a door, a circular interior component and a circular exterior component. Such components are individually configured and correlated with respect to each other so as to attain the desired objective.

The device 10 includes a door 12 having an opening 14 therethrough. The opening 14 is about five feet above a recipient surface 16. The opening 14 has a diameter of a predetermined distance. The opening 14 is positioned as such so that voices of people of varying heights can be heard. Note FIG. 1.

The device 10 includes a circular interior component 20 comprising an outer plate 22 and an inner plate 24. The circular component 20 is positioned with respect to the opening 14 at an interior of the door 12. The outer place 22 has a diameter of a predetermined distance greater than the diameter of the opening 14 in the door 12. The outer plate 22 has an inwardly extending peripheral wall 26 abutting the door 12. The outer plate 22 has a pair of internally threaded collars 28 extending inwardly therefrom. The outer plate 22 has a plurality of apertures 30 therethrough arranged in two concentric circles. Note FIG. 2. The outer plate 22 has an arcuate slot 32 therethrough disposed within an outer circle thereof. The inner plate 24 has a diameter of a predetermined distance less than the diameter of the opening 14 in the door 12. Note FIG. 3. The inner plate 24 has a plurality of apertures 34 therethrough arranged in two concentric circles. The inner plate 24 has a knob 36 extending outwardly therefrom disposed within an outer circle thereof. The circular interior component 20 includes a central shaft 38 extending through a central portion of the inner plate 24 and secured to a central portion of the outer plate 22. The central shaft 38 has a spring 40 disposed thereon for urging the inner plate 24 against the outer plate 22 with the knob 36 extending through the arcuate slot 32 whereby shifting of the knob 36 to a first position will align the apertures 30,34 of the outer plate 22 and the inner plate 24. Shifting of the knob 36 to a second position will disalign the apertures 30,34. Note FIG. 5.

Lastly, the device 10 includes a circular exterior component 44 comprising a singular plate 46. The circular exterior component 44 is positioned with respect to the opening 14 at an exterior of the door 12. The singular plate 46 has a diameter of a predetermined distance equal to the diameter of the outer plate 22 of the circular interior component 20. The singular plate 46 has a plurality of slots 48 therethrough. The plurality of slots 48 are aligned with the plurality of apertures 30 of the outer plate 22 of the circular interior component 20. The singular plate 46 has a pair of externally threaded rods 50 extending inwardly thereof for coupling with the internally threaded collars 28 of the outer plate 22.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A communication portal for providing a safer means for identifying a person knocking on a door comprising, in combination:

said door having an opening therethrough, the opening being about five feet above a recipient surface, the opening having a diameter of a predetermined distance;

a circular interior component comprising an outer plate and an inner plate, the circular component positioned with respect to the opening at an interior of the door, the outer plate having a diameter of a predetermined distance greater than the diameter of the opening in the door, the outer plate having an inwardly extending peripheral wall abutting the door, the outer plate having a pair of internally threaded collars extending inwardly therefrom, the outer plate having a plurality of apertures therethrough arranged in two concentric circles, the outer plate having an arcuate slot therethrohgh disposed within an outer circle thereof, the inner plate having a diameter of a predetermined distance less than the diameter of the opening in the door, the inner plate having a plurality of apertures therethrough arranged in two concentric circles, the inner plate having a knob extending outwardly therefrom disposed within an outer circle thereof, the circular interior component including a central shaft extending through a central portion of the inner plate and secured to a central portion of the outer plate, the central shaft having a spring disposed thereon for urging the inner plate against the outer plate with the knob extending through the arcuate slot whereby shifting of the knob to a first position will align the apertures of the outer plate and the inner plate, shifting of the knob to a second position will disalign the apertures; and a circular exterior component comprising a singular plate, the circular exterior component positioned with respect to the opening at an exterior of the door, the singular plate having a diameter of a predetermined distance equal to the diameter of the outer plate of the circular interior component, the singular plate having a plurality of slots therethrough, the plurality of slots being aligned with the plurality of apertures of the outer plate of the circular interior component, the singular plate having a pair of externally threaded rods extending inwardly thereof for coupling with the internally threaded collars of the outer plate.

2. A communication portal comprising:

a circular interior component comprising an outer plate and an inner plate, the outer plate having a plurality of apertures therethrough, the outer plate having an arcuate slot therethrough, the inner plate having a plurality of apertures therethrough, the inner plate having a knob extending outwardly therefrom, means for urging the inner plate against the outer plate with the knob extending through the arcuate slot whereby shifting of the knob to a first position will align the apertures of the outer plate and the inner plate, shifting of the knob to a second position will disalign the apertures; and a circular exterior component comprising a singular plate, the singular plate having a plurality of slots therethrough, the plurality of slots being aligned with the plurality of apertures of the outer plate of the circular interior component, the singular plate coupled with the circular interior component within an opening in an existing door.

3. The communication portal as set forth in claim 2 wherein the plurality of apertures of the outer plate and the inner plate being arranged in two concentric circles.

4. The communication portal as set forth in claim 2 wherein the means for urging further including a central shaft extending through a central portion of the inner plate and secured to a central portion of the outer plate, the central shaft having a spring disposed thereon for urging the inner plate against the outer plate.

5. The communication portal as set forth in claim 2 wherein the singular plate having a pair of externally threaded rods extending inwardly thereof for coupling with internally threaded collars of the outer plate.

* * * * *